US008413640B2

(12) United States Patent
Mair et al.

(10) Patent No.: US 8,413,640 B2
(45) Date of Patent: Apr. 9, 2013

(54) EMISSIONS CLEANING SYSTEM AND METHOD FOR REDUCING EMISSIONS OF INTERNAL COMBUSTION ENGINES WHEN THE ENGINE IS SWITCHED OFF

(75) Inventors: Stefan Mair, Wachlehen (DE); Michael Rampfl, Grosskarolinenfeld (DE); Klaus Breuer, Aschau (DE)

(73) Assignee: Fraunhofer-Gesellschaft zur Forderung der Angewandten Forschung E.V., Munich (DE)

( * ) Notice: Subject to any disclaimer, the term of this patent is extended or adjusted under 35 U.S.C. 154(b) by 0 days.

(21) Appl. No.: 13/150,602

(22) Filed: Jun. 1, 2011

(65) Prior Publication Data

US 2011/0290107 A1 Dec. 1, 2011

Related U.S. Application Data

(63) Continuation of application No. PCT/EP2008/010182, filed on Dec. 1, 2008.

(51) Int. Cl.
*F02M 33/04* (2006.01)

(52) U.S. Cl.
USPC ..... 123/518; 55/385.3; 60/283; 96/108; 96/111

(58) Field of Classification Search ..... 55/385.3; 123/518, 519, 520; 60/283; 96/108, 111
See application file for complete search history.

(56) References Cited

U.S. PATENT DOCUMENTS

| | | | | |
|---|---|---|---|---|
| 5,823,171 | A | 10/1998 | Farmer et al. | |
| 6,736,115 | B1 | 5/2004 | Leffel et al. | |
| 7,107,759 | B2 * | 9/2006 | Annoura et al. | 60/283 |
| 2002/0096148 | A1 | 7/2002 | Trumpy et al. | |
| 2005/0011185 | A1 | 1/2005 | Annoura et al. | |

FOREIGN PATENT DOCUMENTS

| | | |
|---|---|---|
| EP | 1022451 | 1/2000 |
| WO | 02057615 | 7/2002 |

OTHER PUBLICATIONS

English translation of the International Preliminary Report on Patentability issued in connection with PCT Application No. PCT/EP2008/010182.
The International Search Report issued in connection with PCT Application No. PCT/EP2008/010182.

* cited by examiner

*Primary Examiner* — Robert Clemente
(74) *Attorney, Agent, or Firm* — Gesmer Updegrove LLP

(57) ABSTRACT

The invention relates to an emission cleaning system which is disposed on the intake tract of an internal combustion engine and has at least one device for taking in air and also at least one filter unit and a control/regulating device.

8 Claims, 1 Drawing Sheet

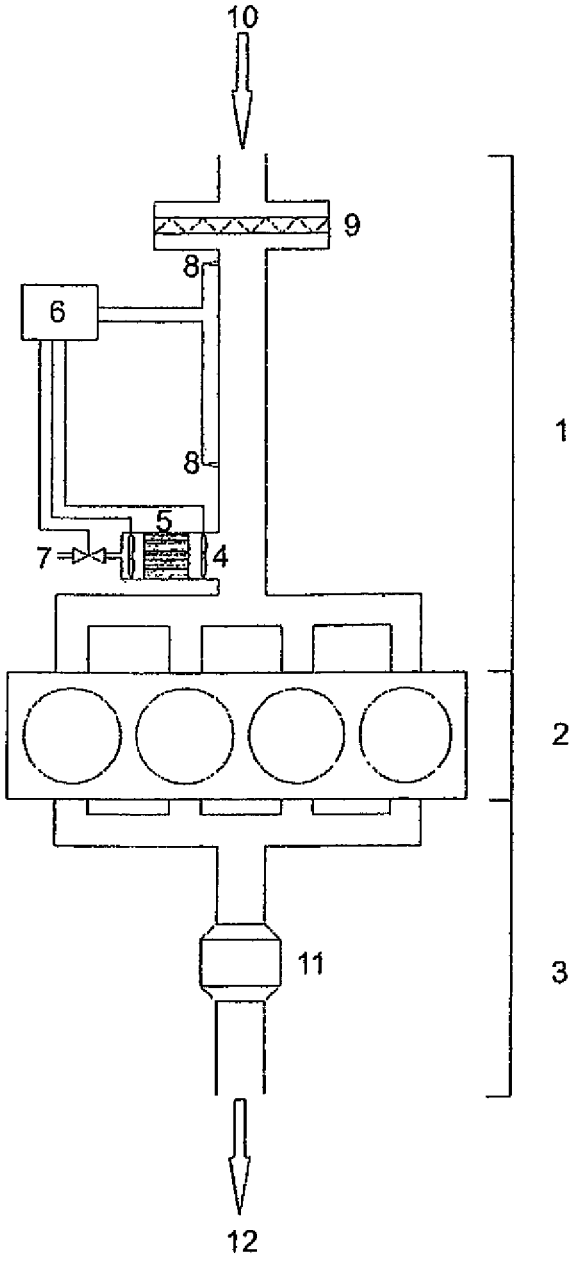
10
9
8
6
8
1
5
7
4
2
11
3
12

EMISSIONS CLEANING SYSTEM AND METHOD FOR REDUCING EMISSIONS OF INTERNAL COMBUSTION ENGINES WHEN THE ENGINE IS SWITCHED OFF

PRIORITY INFORMATION

The present invention is a continuation of International Application No. PCT/EP2008/010182, filed on Dec. 1, 2008 which is incorporated herein by reference in its entirety.

BACKGROUND OF THE INVENTION

Vehicles emit highly volatile organic compounds. The emissions concern, on the one hand, so-called "non-fuel emissions" which belong in the field of material emissions, e.g. of plastic material parts, fresh paints, adhesives or sealing materials. On the other hand, the emissions concern so-called "fuel emissions" which occur in the field of fuel-conducting elements and components (fuel tank unit, fuel lines, internal combustion engine with attachments). Fuel emissions move essentially, when the engine is switched off, out of the engine interior (piston chamber) via open valves into the air intake tract and the exhaust gas unit. Emissions via the exhaust gas unit can be regarded as non-critical since the fuel vapours are retained/broken down via the catalytic converter. The order of magnitude of the fuel emissions from the engine interior via the air intake tract to the external atmosphere is, according to the type of engine, between 1 mg up to several grams over a period of time of time of 24 hours. Legally prescribed limits for the emissions of highly volatile compounds of entire vehicles are, at e.g. 0.5 grams within 24 hours (CARB—California Air Resources Board, EPA—Environmental Protection Agency), significantly lower. For this reason, the fuel emissions in the region of the engine must be significantly reduced via HC sinks (barriers which prevent the vapourisation of fuel) in order to be able to maintain the limits for the entire vehicle.

The reduction in emissions of highly volatile compounds in the motor vehicle field is achieved by extensive measures which extend over the entire vehicle. The measures comprise for example the use of new or modified materials in the non-fuel and in the fuel field but also the application of specific emission-reducing measures. In the air intake tract, new vehicle models are equipped at present, in addition to the air filter, with activated carbon fleeces in the air intake path which are intended to prevent escape of highly volatile organic compounds by adsorption in the form of a diffusion barrier. These activated carbon fleeces are cost-intensive, produce a dynamic pressure in the intake air (=>power losses, more consumption of fuel) during the driving operation and are limited in their dimensioning since they must at most be only a few millimetres thick in order not to lead to too great a power reduction. However, this in turn has a negative effect on the adsorption behaviour of the activated carbon fleeces. In the worst case, high concentrations lead to a so-called breakthrough. This means that the organic compounds move out of the motor interior to the external atmosphere despite the fleece, after saturation thereof, via diffusion processes and a vehicle does not observe the limit in an official test. In addition to the activated carbon fleeces, further passively acting systems, e.g. "HC catalytic converter", "activated carbon bypass", activated carbon covering of the wall materials of the air intake system etc., are at present being tested for their everyday serviceability, which systems exploit the diffusion behaviour of highly volatile organic compounds from the engine interior into the open air.

The US and particularly Californian legislation of the CARB authorities has assumed a role of front runner with the worldwide lowest limits in the field of total emissions of highly volatile organic compounds. The limits of the CARB legislation have been/are already taken up by other US States and nations (Korea, Japan) and are also binding there. The EU will correspondingly follow suit within the scope of new draft bills. Hence there is a great requirement to equip internal combustion engines such that a reduced emission of highly volatile organic compounds is ensured.

SUMMARY OF THE INVENTION

Starting herefrom, it is hence the object of the present invention to provide a system which enables a reduced emission of toxic substances from motor vehicles when the engine is switched off. It is likewise the object of the present invention to indicate a corresponding method for reducing emissions.

This object is achieved, with respect to the emission cleaning system, by the features of patent claim 1, and, with respect to the method for reducing emissions, by the features of patent claim 10. The further dependent claims reveal advantageous developments.

According to the invention, an emission cleaning system which is disposed on the intake tract of an internal combustion engine is hence provided, comprising 1) at least one device for taking in air which is disposed on the air intake tract connected to the intake tract,
2) at least one filter unit which is connected to the device for taking in air and has an air outlet, and also
3) a control/regulating device which controls/regulates the device for taking in air.

The solution path proposed according to the invention for preventing emissions of highly volatile organic compounds via the air intake tract of internal combustion engines resides in the active reduction in concentration of highly volatile compounds in the air intake tract. This can be effected either by a prescribed time interval or when a threshold value is exceeded. If a threshold value is reached in the vicinity of the opening to the external atmosphere, external air is taken in by the intake system preferably for a short time, actively for example via a fan, a blower, a pump or by low pressure, and the gas flow is conducted through a filter unit for reducing the concentration by adsorption/decomposition/degradation of the highly volatile compounds.

Specific backwashing of the filter unit can be effected for example during subsequent engine operation, in which then possibly the highly volatile organic compounds can be supplied for combustion in the engine. It is hereby advantageous that no fuel is lost by diffusion.

Monitoring the threshold value in the vicinity of the opening to the external atmosphere can be effected for example via sensors in the air intake system, which are suitable for recording differences in the concentration of highly volatile organic compounds in the air. The at least one sensor is thereby disposed in the region of the opening to the external air of the intake tract and the control/regulating unit regulates/controls the device for taking in air as a function of the measured emission.

Furthermore, it is advantageous that at least two mutually spaced sensors are disposed in the region of the opening to the external air of the intake tract.

There are thereby used as preferred sensor, in particular a WLD-, FID-, PID-, semiconductor-, IR- and/or oscillating quartz sensor.

In particular, the device for taking in air is a fan, a blower, a pump or a low pressure unit.

In a further preferred embodiment, the filter unit is an activated carbon filter or a molecular sieve.

It is thereby likewise advantageous if the filter unit is dimensioned such that 0.01 mg to 100,000 g, preferably 1 mg to 100 g, can be absorbed.

In a further preferred embodiment, the device for taking in air and the filter unit with the air outlet are disposed in the form of at least one component on the air intake tract.

Advantageously, the filter unit is connected to a backwash device which is connected to the internal combustion part of the engine.

According to the invention, a method for reducing emissions of internal combustion engines of vehicles when the engine is switched off is likewise provided, in which air is taken in for a prescribed time interval and/or by determining the concentrations of the emissions in the intake tract and by a prescribed limit being exceeded and this taken-in air is guided externally via a filter unit disposed on the intake tract.

A time control of the system according to the invention is likewise conceivable. As a function of the geometry and the diffusion behaviour of highly volatile organic compounds in the air intake system (diffusion coefficients of petrol can be calculated), a gas flow would be produced briefly after defined time intervals. The time interval would have to be either determined experimentally or calculated for this purpose.

It is thereby preferred in the method if, when the internal combustion engine is running, a recirculation of the emissions deposited in the filter unit into the internal combustion engine is effected.

In particular, the method according to the invention can be implemented with an above-described device according to the invention.

Advantages which accompany the system according to the invention and the method according to the invention are in particular:

reduction in highly volatile emissions from the air intake tract of internal combustion engines, no additional air resistance in the air intake tract. No dynamic pressure is built up, as is the case with other HC sinks which are incorporated in the flow path, =>more power, less fuel consumption, no saturation of the filter unit since the packing size/dimensioning/capacity of the HC sink can be freely chosen (adaptation to requirement/emission behaviour).

The technical application extends to vehicles (automobiles/cars, boats, ships, buses, lorries, motorcycles, rail vehicles, snowmobiles, piste vehicles/internal combustion engines of all manufacturers) which are subject to legal regulations with respect to the emission of highly volatile organic compounds or are intended to reduce the described emissions of highly volatile organic compounds.

The present invention is explained in more detail with reference to the following embodiments, given by way of example, and the accompanying FIGURE without restricting the invention to the represented embodiments and parameters.

The invention relates to the technical implementation/method for reducing highly volatile organic emissions (HC, VOC) from the air intake tract of internal combustion engines by means of active gas flow through a filter unit when the engine is switched off. The produced, active gas flow for reducing the concentration of highly volatile organic compounds is conducted through a filter unit which is suitable for withdrawing highly volatile organic compounds from the air by adsorption and/or by catalytic breakdown.

The active gas flow can thereby be ensured by a fan, a blower, a pump, a nozzle, a low pressure unit, a high pressure unit, a combination of several of the listed methods or by another possibility which is suitable for producing a gas flow.

The filter unit can be filled with an adsorber material which is suitable for absorbing highly volatile organic compounds, and/or with a catalytic material which is suitable for breaking down highly volatile organic compounds.

The technical application of the filter unit or the method extends to internal combustion engines/motor vehicles (automobiles/cars, boats, ships, buses, lorries, pickup trucks, motorcycles, rail vehicles, agricultural machines, snowmobiles, piste vehicles) which are subject to legal regulations (national and international) with respect to the emission of highly volatile organic compounds.

The quantity of adsorptively operating material of the filter unit should be dimensioned corresponding to the quantities of highly volatile organic compounds occurring and extends over a capacity range of 0.01 mg to 100,000 g of highly volatile organic compounds. Of particular importance are filter units with a capacity of 1 mg to 100 g of highly volatile organic compounds.

Catalytically operating materials must be dimensioned corresponding to the quantities of highly volatile organic compounds occurring. The catalytic activity of HC-degrading compounds must be designed for a quantity of 0.01 mg to 100,000 g of highly volatile organic compounds per 24. Of particular importance are filter units with a catalytic activity for a quantity of 1 mg to 100 g of highly volatile organic compounds per 24 hours.

The adsorptively operating material of the filter unit can be possibly backwashed during the driving operation with airstream, the highly volatile organic compounds being supplied to the internal combustion process of the engine and the layer being available in regenerated form during the next switch-off process.

The adsorptively operating material of the filter unit can possibly be heated in order to improve the results of the backwash process by thermal desorption.

For active control of the gas flow, a time control which is coordinated corresponding to the geometry of the air intake tract and to the diffusion behaviour of the highly volatile organic compounds can be used.

DETAILED DESCRIPTION OF THE ILLUSTRATED EMBODIMENT

In the accompanying FIG. 1, an engine block 2 with associated exhaust gas unit 3 is represented, the emission cleaning system 5 according to the invention with filter unit and fan, blower, pump or low pressure unit being fitted in the air intake tract 1. The emission cleaning system 5 is thereby connected via the air inlet opening 4 leading to the emission cleaning system to the air intake tract 1 of the engine block 2. The emission cleaning system 5 has an air outlet 7 which is connected to a control/regulating device 6. The sensors 8 can be actuated via this. In the air intake tract, an air filter 9 is thereby likewise fitted. The intake direction for air during engine operation is indicated with 10. The exhaust gas unit 3 likewise includes a catalytic converter 11. The outlet direction for exhaust gases during engine operation is indicated with 12.

What is claimed is:

1. An emission cleaning system which is disposed on the intake tract of an internal combustion, comprising:

1) at least one device for taking in air which is disposed on an air intake tract connected to the intake tract,
2) at least one filter unit which is connected to the device for taking in air and has an air outlet, and
3) a control/regulating device which controls/regulates the device for taking in air, and wherein in addition at least one sensor for determining the concentrations of the emissions is provided, the at least one sensor being disposed in the region of an opening to the external air of the intake tract, and the control/regulating unit controls/regulates the device for taking in air as a function of the measured emission.

2. The emission cleaning system according to claim 1, wherein at least two mutually spaced sensors are disposed in the region of the opening to the external air of the intake tract.

3. The emission cleaning system according to claim 1, wherein the device for taking in air is a fan, a blower, a pump or a low pressure unit.

4. The emission cleaning system according to the claim 1, wherein the filter unit is an activated carbon filter or a molecular sieve.

5. The emission cleaning device according to claim 1, wherein the filter unit is dimensioned such that 0.01 mg to 100,000 g can be absorbed.

6. The emission cleaning system according to claim 1, wherein the device for taking in air and the filter unit with the air outlet are disposed in the form of at least one component on the air intake tract.

7. The emission cleaning system according to claim 1, wherein the filter unit is connected to a backwash device which is connected to the internal combustion part of the engine.

8. The emission cleaning device according to claim 1, wherein there is used as sensor, a WLD-, FID-, PID-, semiconductor-, IR- and/or oscillating quartz sensor.

* * * * *